United States Patent [19]

Pirolli

[11] Patent Number: 4,878,433

[45] Date of Patent: Nov. 7, 1989

[54] DEVICE FOR NEUTRALIZING MILITARY OBJECTS

[75] Inventor: Claude Pirolli, Rueil-Malmaison, France

[73] Assignee: Telecommunications Radioelectriques et Telephoniques, Paris, France

[21] Appl. No.: 485,517

[22] Filed: Apr. 12, 1983

[30] Foreign Application Priority Data

May 12, 1982 [FR] France ..... 82 08273

[51] Int. Cl.[4] ..... F42B 25/02

[52] U.S. Cl. ..... 102/384; 102/387

[58] Field of Search ..... 102/384, 387, 393, 489, 102/213; 244/3.16

[56] References Cited

U.S. PATENT DOCUMENTS 4,050,381 9/1977 Heinemann ..... 102/387
4,417,520 11/1983 Maudal ..... 102/384
4,492,166 1/1985 Purcell ..... 102/384

FOREIGN PATENT DOCUMENTS 2478297 9/1981 France ..... 102/387

*Primary Examiner*—Charles T. Jordan
*Attorney, Agent, or Firm*—Stevens, Davis, Miller & Mosher

[57] ABSTRACT

A device for neutralizing military objects by means of sub-munitions released by a mother rocket onto mobile targets on the ground. Each sub-munition (1) is provided with a military charge (2) and a wide range sensor (3) and descends while suspended from a parachute and turns uniformly about a vertical axis of symmetry (10), the angle formed by the firing axis (5) and the vertical being constant. Superimposed upon this rotational movement of the sub-munition, the periodic oscillatory movement of an orientable mirror (14) permits varying the direction of the optical axis (8') with respect to the firing axis during the detection phases of a target and the guiding of the sub-munition towards the detected target. Thus at each oscillation period of the orientable mirror the complete image of the circular area on the ground is obtained. In the last phase of firing, when aimed at the target, the optical axis is maintained in the direction of the firing axis.

3 Claims, 5 Drawing Sheets

DEVICE FOR NEUTRALIZING MILITARY OBJECTS

BACKGROUND OF THE INVENTION

The invention relates to an improvement in a device for neutralizing military objects, the said device consisting of launching a mother rocket above the said objects and making it release an assembly of sub-munitions towards elementary targets which are mobile on the ground and are distributed in large numbers on an extended area, each of the said sub-munitions which has a military charge and is suspended from an aircraft in such a position that its firing axis forms a constant angle with the vertical comprising:

means ensuring its substantially uniform rotational movement about the vertical axis passing through its suspension point from the aircraft in such manner that, when the aircraft has a substantially uniform vertical descending movement, the firing axis effects a spiral scanning of the ground in order to search for a target;

means for detecting the said target constituted by a sensor of narrow field of view comprising one or several detectors and an optical system orienting and concentrating the radiation of the detected target on the detectors;

guiding means in the horizontal plane towards the detected target;

the aimed fire being started when a detection of the target is effected at an altitude which is lower than a limit imposed by the range of the military charge.

The search for important military objects situated beyond the distance of visibility (that is to say at, for example, 30 or 40 kilometers from the point of observation) is one of the missions which fall to the systems of arms with terminal guiding.

It is to be noted that said important military objects such as a group of at least a dozen tanks, an anti-aircraft base, a control station, etc . . . are characterized by elementary targets of a known nature (tank, battery, lorry etc . . . ) distributed in a large number on areas of several hectares according to well-defined deployment rules.

Devices operating according to the analysis mode described in the opening paragraph have been devised in various western countries (see French Pat. No. 2,478,297). They will hereinafter be designated by the acronym TACED (Tête Anti-Char à Effet Dirigé) (anti-tank head with directed effect).

If the analysis mode by spiral scanning characterizing the TACED is sufficient to effect an aimed fire during the passage on a target, it is on the contrary poorly adaptated to the function "detection" necessary to realize the guiding. In fact at least three gaps which are inherent in said analysis mode may be mentioned:

(a) it is substantially impossible to take into account all the information available to detect the object (number of targets, deployment) since, if the detection process would be followed after the discovery of the first target, the following targets would appear one by one and the calculation of their relative positions would be inextricable;

(b) consequently, there is no criterion whatsoever to choose the target on which the guiding is to be effected. Said target will thus generally be the first target detected. In unfavourable conditions, however, it is possible that the guided sub-munition does not have the time to recapture the mobile target chosen, whereas it would have successfully tracked another target moving at the same speed.

(c) the tracking of a target necessitates an absolute reference. In the absence of an absolute reference the localization of the target is effected in a mobile reference system connected to the aircraft. Since the target can be detected only when the sub-munition is on a particular cone, the measurements of localization are not periodic and an important time may lapse between two successive localizations. During that time the mobile reference system may turn in an uncontrollable manner. The guiding movement may thus be influenced by considerable errors and, at the boundary, may be locked, bringing the sub-munition periodically at its point of departure. In these conditions the tracking is impossible. A means of escaping this defect would consist in localizing the target with respect to an absolute reference, which would no doubt introduce complex means.

SUMMARY OF THE INVENTION

It is the object of the invention to perfect the device described in the opening paragraph, which perfection, while preserving the simplicity of the spiral mode of scanning in the final phase of firing, permits of using a different and better adapted mode of scanning in the intermediary phases of detection and guiding.

In the TACED system the optical axis of the sensor is substantially coming together with the firing axis of the sub-munition. The perfection according to the invention makes the direction of said optical axis vary with respect to the firing axis in the vertical plane of symetry of the device. Thus a complete image of the circular area on the ground is obtained, which permits of having the disposal of all the information concerning the object—with a renewal rate which may be rapid—to effect the functions "detection of the target" and "guiding towards said target".

The device according to the present invention hence is remarkable in that the said optical system comprises a deviator of low inertia interposed on its optical path and activates during the detection and guiding phases by a periodic oscillatory movement in such manner as to control the direction of the optical axis between two limited positions, the movement of the said deviator superimposed on the uniform rotational movement of the sub-munition about its vertical axis permitting to explore a circular area on the ground in each period of oscillation and the said deviator being maintained in a fixed position such that the optical axis of the sensor is substantially parallel to the axis of firing during the last phase of operation of the device corresponding to the fire aimed at the detected target.

The deviator may be manufactured in a simple manner by means of a reflecting mirror which can be oriented and the periodic oscillatory movement of which is obtained preferably by a mechanical coupling on the movement of rotation of the sub-munition.

BRIEF DESCRIPTION OF THE DRAWINGS

From the following description with reference to the accompanying drawings, the whole given by way of example, it will be better understood how the invention can be realized.

DETAILED DESCRIPTION OF PREFERRED EMBODIMENTS

Figure 1:
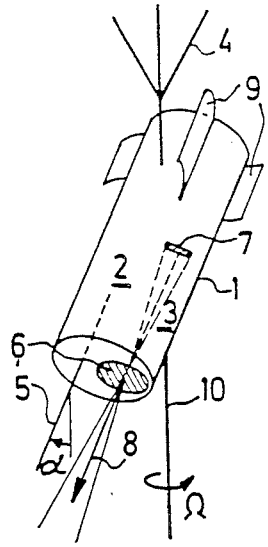
FIG. 1 is a simplified perspective view of a released sub-munition used in the TACED system.

FIG. 1 is a simplified perspective view of the sub-munition 1 ussed in the TACED system. Said sub-munition constituted principally by a military charge 2 and by a narrow field sensor 3 suspended from an aircraft, for example, a parachute 4 in such a position that the firing axis 5 of the sub-munition forms a constant angle $\alpha$ with the vertical. Various types of sensors may be considered: infrared detector, radar, radiometers etc . . . or any combination of said detection means. It will be supposed hereinafter that the detection is realized by an infrared sensor comprising an objective 6 with focus f and an array of N detectors 7 in the vertical plane, each of them having the form of a square having a side a in such manner that the separating power of a detector is $\epsilon = a/f$. The optical axis 8 of the sensor is mechanically matched to the firing axis 5 of the sum-munition (the two axes are substantially aligned one on the other except for a slight shift). Flaps 9 provided on the sub-munition ensure its rotational movement at the angular speed $\Omega$ around the vertical axis 10 passing through its suspension point from the parachute. Said rotation results from the aerodynamic pressure on the flaps.

In theoretical conditions, that is to say when the descent of the parachute and the vertical axis of rotation of the sub-munition are uniform, the track on the ground of the firing axis describes a spiral. Said mode of scanning in a spiral characterizing the TACED is shown diagrammatically in FIG. 2. If only one single detector is used in the focal plane, the instantaneous field of view of the sensor is a solid angle having a side $\epsilon$. Let M be the center of the field of view on the ground, that is to say the track of the optical axis and the firing axis (coming together with a same direction Oz). The point M describes the spiral s at constant speed while approaching the point H orthogonal projection on the plane of the ground (S) of the centre (O) of the sensor. When during the scanning in the form of a spiral the field of view detects a target C, the sensor detects a variation of the incident radiation and the signal resulting from said variation permits firing at the target at that instant.

Since in practice not a single detector is used but an array of N detectors in the vertical plane (V), the instantaneous field of view will have a length $N\epsilon$ in said vertical plane. The presence of said N detectors has a double purpose:

(a) to guarantee that all the points on the ground are analyzed at least once in spite of disturbing movements which may influence the scanning in real conditions;

(b) to provide an image of the target with better definition, which permits a better identification and the choice of a precise point of impact.

Summarizing, the TACED system advantageously uses the fact that, in order to fire at a target, it is in principle sufficient to observe the points on the ground once and once on the interior of the covered area.

Figure 2:
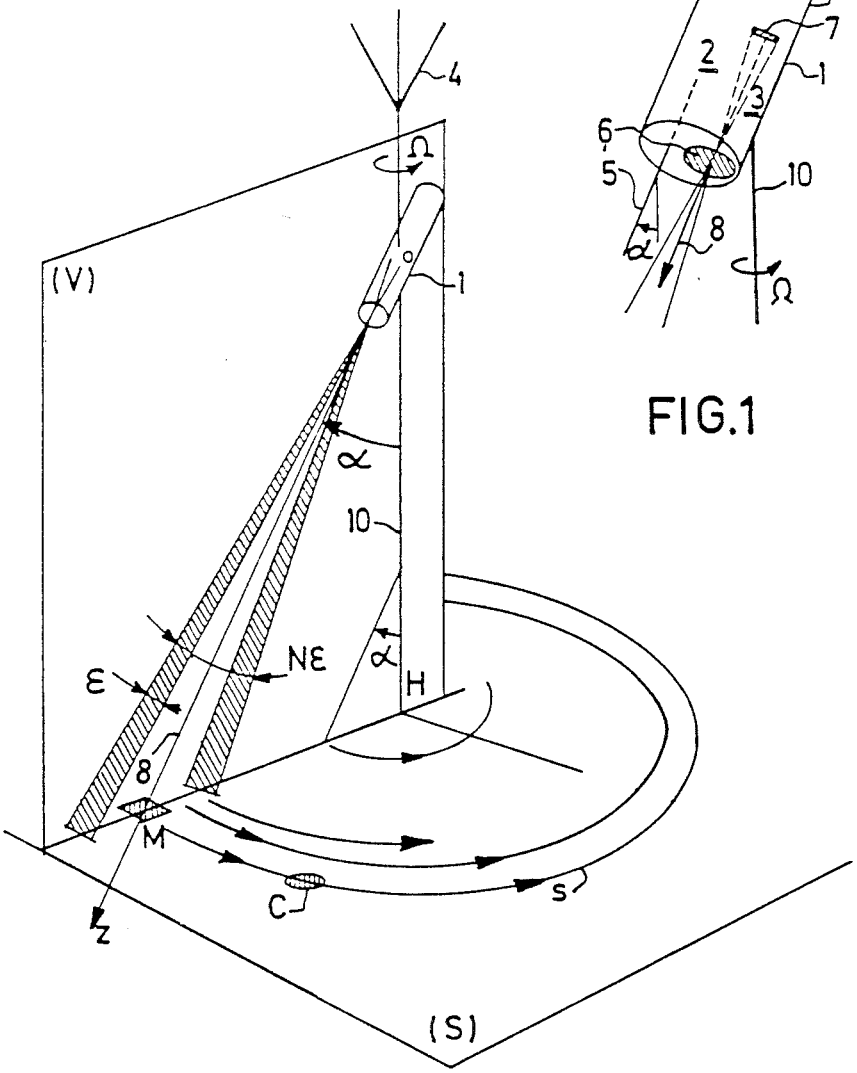
FIG. 2 shows diagrammatically the mode of scanning on the ground.

The military charges in view for the TACED have ranged OM=r limited to a hundred meters on the armoured plates. Since the angle $\alpha$ is of the order of 30°, the lethal radius HM of the sub-munition is at most fifty meters (FIG. 2). Thus limited, the concept of the TACED loses a great part of its interest: for example, a group of 6 sub-munitions released at random on an object extending over some twenty hectares has only a very small efficacity.

Figure 3:
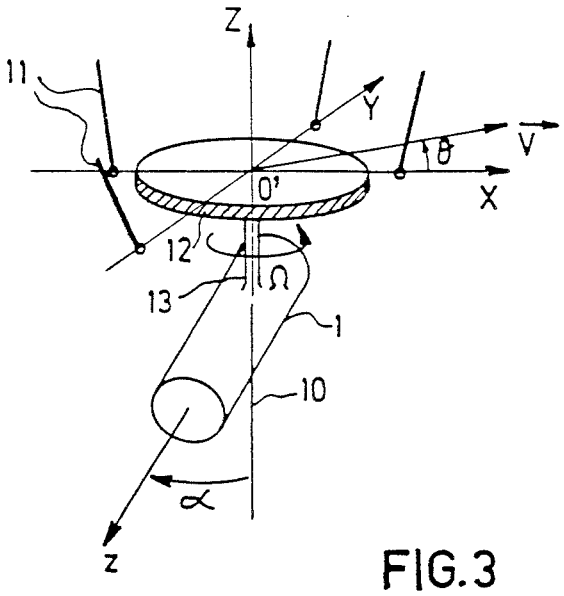
FIG. 3 shows the means to control the direction of the horizontal guiding of the sub-munition.

A means of obviating said deficiency consists in using a wide range sensor which is capable of detecting a target in a lethal radius of several hundred meters and equipping the sub-munition with guiding means in the horizontal plane towards the detected target. For example, a sub-munition guided with the aid of a parachute of the existing type may be constituted which presents a fineness of the order of 3. FIG. 3 shows the means to control the direction of the horizontal guiding in the mobile reference system connected to the parachute. The guided parachute 4 is connected by its suspension points 11 to a horizontal platform 12 from which the sub-munition 1 is suspended at O' with the intermediary of a roller 13 having a vertical axis 10. The sub-munition thus can turn with respect to the platform 12 around the vertical axis 10 of direction O'Z. While more or less influencing the suspension ropes connected to the orthogonal axis of directions O'X and O'Y, respectively, the vector speed $\vec{V}$ forming any angle $\theta$ with the axis O'X in the horizontal plane can be oriented, that is to say the direction of the horizontal guiding in the mobile reference system O'XY connected to the parachute can be controlled.

FIG. 4 shows two scenarios of guiding among a multitude of others. Supposing, for simplicity, that all the guiding movements are contained in the same vertical plane, the detections of a target are possible only if the successive positions $O_1$, $O_2$, . . . of the sub-munition are situated at the intersection of said plane with the cone of revolution of the vertical axis having the target as summit and an angle to the summit equal to $2\alpha$.

Figure 4A:
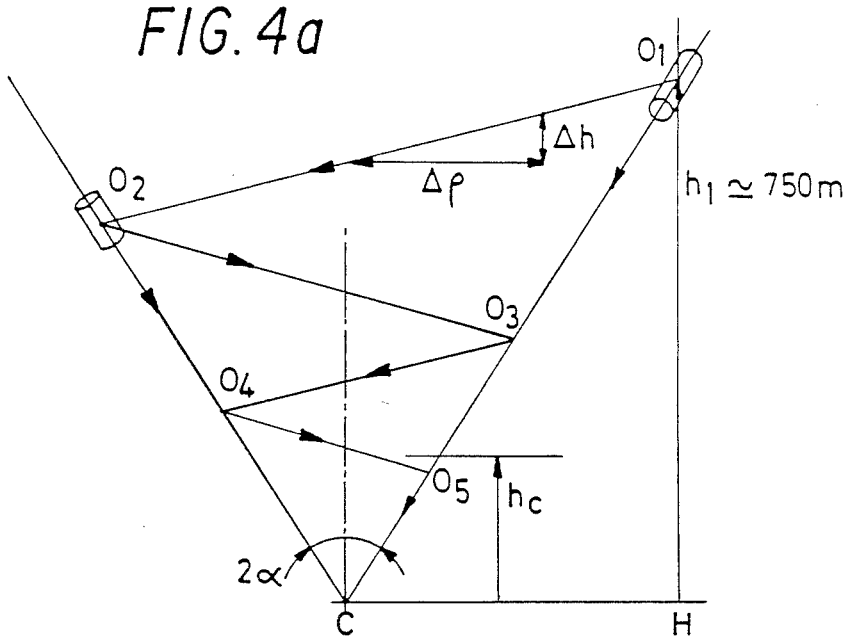
FIG. 4 shows two possibilities of scenario for guiding the sub-munition towards a detected target.

In a first scenario shown in FIG. 4*a* the sub-munition, after a first detection of the target at $O_1$ at an altitude $h_1$ of 750 m, experiences a first guiding $O_1 O_2$ according to a slope of descent $\Delta h/\Delta p = \frac{1}{3}$; the target is detected for a second time at $O_2$, then the sub-munition experiences a guiding $O_2 O_3$ according to a slope of descent $\frac{1}{3}$ and so on until the fifth detection $O_5$ for which the altitude of the sub-munition is smaller then the limit $h_c$ of 100 m imposed by the range of the military charge and from which altitude firing at the target is begun.

Figure 4B:
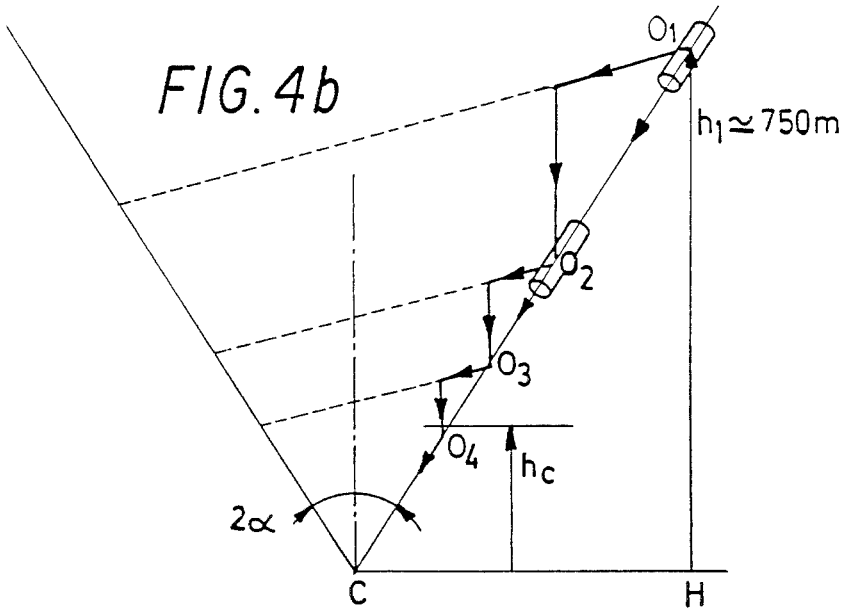

FIG. 4*b* shows a second scenario combining vertical descents and sloping descents $\frac{1}{3}$.

Figure 5:
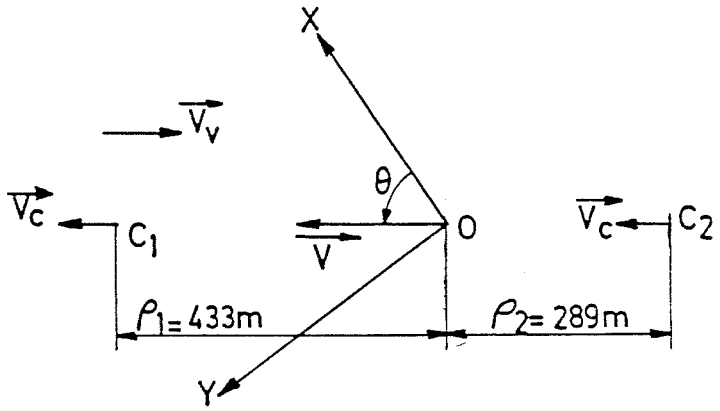
FIG. 5 shows the tracking of two mobile targets (in the most critical situation).

FIG. 5 shows the defect resulting from the analysis mode by scanning in a spiral and resulting in the impossibility of choosing the target which the sub-munition is to track. For example, two mobile targets on the ground $C_1$ and $C_2$ are considered and detected when the sub-munition in a vertical descent is situated at altitudes $h_1=750$ m and $h_2=500$ m, respectively. The corresponding radius vectors in the horizontal plane ($\rho=tg\alpha \cdot h$) have values: $\rho_1=433$ m and $\rho_2=289$ m. The sub-munition shown in the Figure by its mobile reference system O'XY will try to track the target $C_1$ detected first. Let $\vec{v_c}$ be the speed of the targets with respect to the ground, $\vec{v_y}$ the speed of the wind with respect to the ground, $\vec{V}$ the speed of the horizontal guiding with respect to the air; the respective values of these speeds are 10 m/s, 15 m/s and 30 m/s. In these conditions and if the descending speed is otherwise 10 m/s, the sub-munition will pass to the vertical of the target $C_1$ only after 86.6 sec., which value is higher than the descending time of 65 sec. and the target $C_1$ will not be reached. On the contrary, the target $C_2$ could have been tracked successfully if one had not wrongfully been busy tracking $C_1$, for laack of information.

Figure 6:
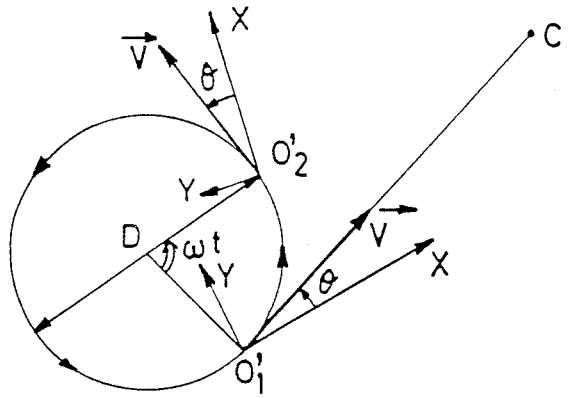
FIG. 6 shows the extreme case leading to the locking of the guiding movement.

Another defect of the TACED system connected with the absence of absolute reference may lead to the locking of the guiding movement. This extreme case is shown in FIG. 6. The reference system O'XY connected to the parachute turns at a constant angular speed $\omega$. The sub-munition describes a circle tangent to the initial speed $\vec{V}$ at $O'_1$ and having a diameter $D=(|\vec{V}|\cdot 2)/\omega$. If $|\vec{V}|=30$ m/s and if the parachute effects 1 turn in twenty seconds, D=190 m.

These various defects of the TACED system can be obviated due to the improvement provided by the present invention and consisting of interposing on the optical track of the sensor a deviator of a low inertia which can orient the optical axis in the vertical plane of symmetry with respect to the firing axis.

Figure 7:
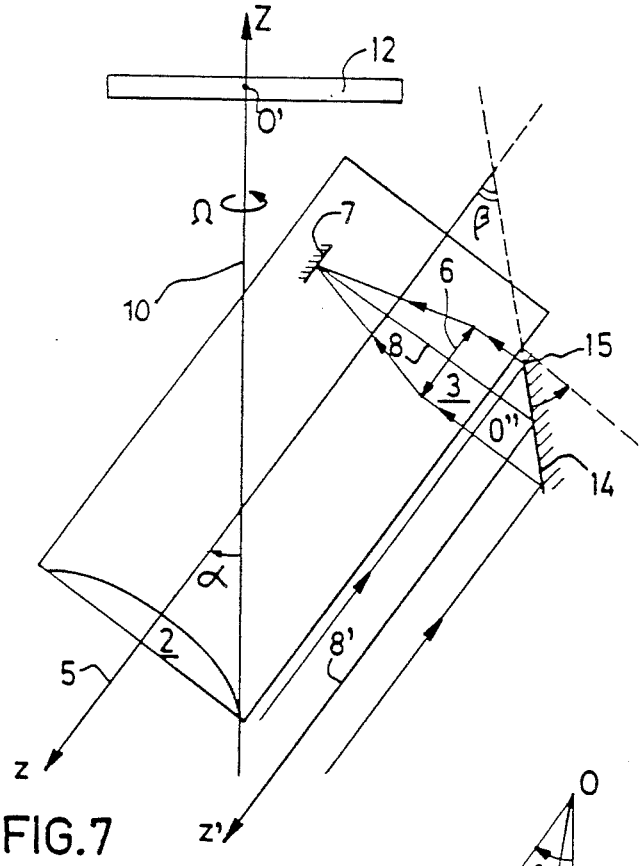
FIG. 7 is a cross-sectional view according to its vertical plane of symmetry of the sub-munition perfected in accordance with the invention.

FIG. 7 shows diagrammatically a simple embodiment drawn in the vertical plane of symmetry comprising the array of N detectors.

In this embodiment, the infrared objective 6 which concentrates the radiation of the target on the detectors 7 situated in its focal plane is disposed in such manner that its optical axis 8 is normal to the firing axis 5 of the sub-munition 1 which is always inclined at an angle $\alpha$ with respect to the vertical speed turning at the angular speed $\Omega$ around the vertical axis of symmetry 10 of the platform 12 connected to the parachute.

The deviator according to the invention is constituted by a reflecting mirror 14 which can turn about an axis 15 and reflects the optical axis 8 of the objective at O'' in the direction O''z which becomes the new optical axis 8' of the sensor. The rotation of the mirror 14 of which the plane forms the angle $\beta$ with the firing axis 5 results in the variation of said angle and thus permits the orientation of the new optical axis according to two limit values $\rho_1$ and $\rho_2$ of the angle $\beta$.

For $\beta_1=45°$, the optical axis 8' is parallel to the firing axis 5. This case is shown in FIG. 7.

For $\beta_2=45°+(\alpha-\gamma)/2$, the optical axis 8' is near the vertical and makes an angle $\gamma$ therewith.

Figure 8:
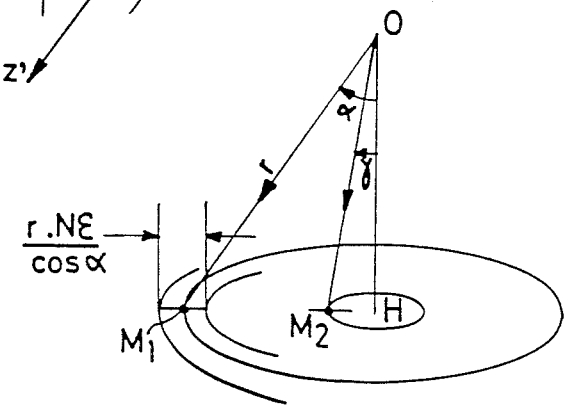
FIG. 8 shows the limits of the area on the ground resulting from the optical scanning according to the invention.

FIG. 8 shows in the vertical plane the limit positions corresponding to the optical axis the tracks of which on the ground are $M_1$ and $M_2$. The track on the ground around $M_1$ of the field of view of N detectors has for its value $(r\cdot N\epsilon)/(\cos\alpha)$ with $OM_1=r$.

The orientation movement of the mirror superimposed on the rotation $\Omega$ of the sub-munition around a vertical axis permits of exploring on the ground a circular area of radius $HM_1$. The central zone of radius $HM_2$ which escapes the analysis represents a negligible surface area with respect to the area (the acceptable minimum value for $HM_2$ is determined by the tolerable low frequency noise power coming from the detector).

Figure 9:
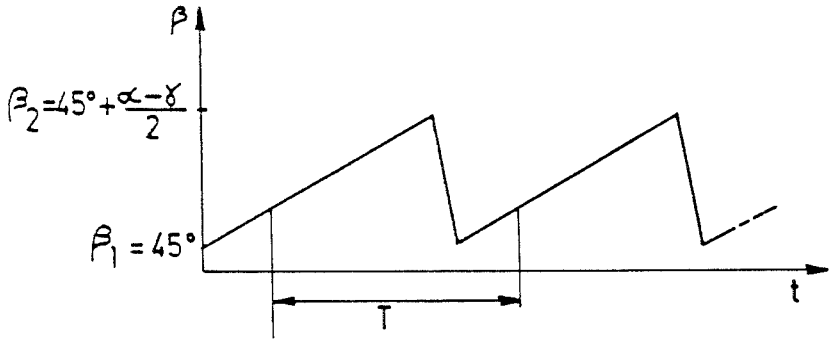
FIG. 9 shows the shape of the periodic variation as a function of time of the angle formed by the orientable plane mirror and the axis of firing.

The mirror 14 being activated by a periodic oscillatory movement such that the angle which its forms with the firing axis varies between the limits defined above. FIG. 9 shows the shape of the variation of said angle $\beta$ as a function of the time t. Let it be assumed that T is the period of said variation.

The movement of the mirror must be sufficiently slow in order that all the points of the area on the ground be analyzed. Said condition may be written while neglecting the return time of the mirror:

$$T \geqq \frac{2\pi}{\Omega} \cdot \frac{\alpha-\gamma}{N\cdot\epsilon}$$

On the other hand it is easy to choose a sufficiently high frequency of renewing the information 1/T in order that the movements of the sub-munition (known movements such as descent and lateral displacement; unknown movements such as drifts and rotations due to the wind) do not result in an appreciable angular displacement of the targets in the period T.

It may be verified that a period T of the order of a second is a good compromise in the following numerical conditions:

$\alpha$: of the order of 45°
$\alpha$: of the order of 15°
$\Omega/2\pi$: of the order of 10 turns/s
N: 16 detectors
$\epsilon=4$ mrd
descending speed=10 m/s
lateral speed=30 m/s
parasitic rotation of the parachute=1 rev./20 s
initial altitude=750 m.

During the whole guiding phase the sensor thus provides every T seconds a complete image of the area located in polar coordinates $(\rho,\theta)$ in the mobile reference system O'XY connected to the platform 12.

$\rho$: radius vector of the runing point determined by the position of the mirror 14 and the sequence of the considered detector.

$\theta$: polar angle determined by the position of the sub-munition with respect to the platform 12.

(This image will generally experience in the receiver a spatial filtering, an amplification with normalization by automatic gain control and a threshold action. A reduced number of characteristic points having passed the threshold will be stored).

The mode of sensing considered above permits of avoiding the defects caused by the spiral mode of sensing during the detecting and guiding phases. In fact:

(a) Each image comprises all the information concerning the object, that is to say the nature and the relative positions of at least a dozen of elementary targets.

The logic decision "detection of the object" may thus be taken in good conditions even if the signal-to-noise ratio on an elementary target is weak since it integrates a dozen of elementary detections.

(b) On the other hand, it is possible while comparing the successive images obtained at intervals T to determine the radial speed (dp)/(dt) of any point. It his hence possible to direct the tracking only to targets which it is known can be reached during the available descending time.

Moreover, it is possible to track not only one target but the average coordinates of a group of several targets while retarding the instant of choice of the object target until the instant when maximum information is available.

(c) Finally it is possible to effect the tracking of any point of the scene directly in the mobile reference system (without using absolute reference), taking into account the high value of the renewal frequency 1: T.

In the firing phase the guiding towards a chosen point of the scene is supposed to be realized. In other words the sub-munition has been guided above a circular zone centred on the chosen target and having radius $R=h_c \cdot tg\alpha$.

Wherein $h_c$: maximum altitude of firing dependent on the considered military charge;

Wherein $\alpha$: predetermined firing angle.

There is no necessity whatsoever, in the firing phase, to get a complete vision of the scene. It is hence sufficient to maintain the mirror in a fixed position so that the firing axis and the optical axis are parallel. (In fact a certain shift will be produced between said two axes which will permit to have the disposal of a calculating time necessary for the exact aiming at the interior of the contour of the target). The sub-munition thus functions according to the concept of the TACED with spiral scanning: firing "in flight" during the passage of the target in the field of view of the sensor.

I claim:

1. A device for neutralizing military objects by launching a mother rocket above the said objects and releasing an assembly of sub-munitions towards elementary targets which are mobile on the ground and are distributed in large numbers over an extended area, each of the said sub-munitions having a military charge capable of being fired and each sub-munition being suspended from an aircraft in such a position that the sub-munition's firing axis forms a constant angle with the vertical comprising:

means ensuring the sub-munition's substantially uniform rotational movement about the vertical axis passing through its suspension point from the aircraft in such manner that, when said aircraft has a substantially uniform vertical descending movement, the firing axis effects a spiral scanning of the ground so as to search for a target;

means for detecting the said target constituted by a sensor having a narrow field of view, comprising one or several detectors and an optical system orienting and concentrating the radiation of the detected target on the detectors;

the firing on said military charge being initiated when a detection of the target is effected at an amplitude lower than a limit imposed by the range of the military charge, characterized in that the said optical system of the sensor comprises a deviator of low inertia interposed on the sensor's optical path and activated during the detection phase by a periodic oscillatory movement in such manner as to control the direction of the optical axis between two limited positions, the movement of the said deviator superimposed upon the uniform rotational movement of the sub-munition about its vertical axis scanning a circular area on the ground in each oscillation period and the said deviator being maintained in a fixed position so that the optical axis of the sensor is substantially parallel to the firing axis during the last phase of operation of the device corresponding to firing the military charge at the detected target.

2. A device as claimed in claim 1, characterized in that the said deviator of low inertia is constituted by a reflecting mirror which can be oriented and the period oscillatory movement is caused by rotational movement of the sub-munition through a mechanical coupling.

3. A target detection system for a sub-munition capable of firing a military charge at a detected target along a firing axis where the dispensed sub-munition is suspended from a descending aircraft and rotates about a substantially vertical axis, said target detection system comprising:

means defining an optical path having a narrow field of view and for focusing radiation along said optical path onto at least one detector, said optical path at least partially forming an angle of greater than 0° but less than 90° with said vertical axis, said detector providing a target detection signal when a target image is focused on said detector; and deviator means for controllably and periodically varying said optical path angle during a detection phase and for maintaining such optical path in a fixed relationship with said firing axis during a firing phase.

* * * * *